US007663584B2

(12) United States Patent
Okuno

(10) Patent No.: US 7,663,584 B2
(45) Date of Patent: Feb. 16, 2010

(54) FIELD SEQUENTIAL LIQUID CRYSTAL DISPLAY

(75) Inventor: Takeshi Okuno, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 716 days.

(21) Appl. No.: 11/327,525

(22) Filed: Jan. 5, 2006

(65) Prior Publication Data

US 2006/0187168 A1 Aug. 24, 2006

(30) Foreign Application Priority Data

Feb. 18, 2005 (KR) ..... 10-2005-0013785

(51) Int. Cl.
*G09G 3/36* (2006.01)

(52) U.S. Cl. ..... 345/87; 345/92; 345/94

(58) Field of Classification Search ..... 345/50–55, 345/83–84, 87–96, 99–100, 204, 208–214, 345/690

See application file for complete search history.

(56) References Cited

U.S. PATENT DOCUMENTS

| | | | |
|---|---|---|---|
| 2,599,311 | A | 6/1952 | Anderson |
| 3,059,359 | A | 10/1962 | Goldammer et al. |
| 3,197,899 | A | 8/1965 | Twentier et al. |
| 3,279,107 | A | 10/1966 | Baumgartner |
| 3,645,023 | A | 2/1972 | Larson |
| 3,656,247 | A | 4/1972 | Bushnell et al. |
| 3,751,835 | A | 8/1973 | Smith |
| 3,965,589 | A | 6/1976 | McDermott |
| 4,199,882 | A | 4/1980 | Clayman |
| 4,221,063 | A | 9/1980 | Charles et al. |
| 4,226,036 | A | 10/1980 | Krug |
| 4,318,234 | A | 3/1982 | Charles et al. |
| 4,328,978 | A | 5/1982 | McLaughlin |
| 4,616,436 | A | 10/1986 | De Woskin |
| 5,092,067 | A | 3/1992 | Prout |
| 5,364,133 | A | 11/1994 | Hofer et al. |
| 5,388,739 | A | 2/1995 | Gargan |
| 5,423,574 | A | 6/1995 | Fort-Pathroff |
| 5,503,114 | A | 4/1996 | Castagna |
| 5,581,924 | A | 12/1996 | Peterson |
| 5,653,472 | A | 8/1997 | Huddleston et al. |

(Continued)

FOREIGN PATENT DOCUMENTS

| | | | |
|---|---|---|---|
| CN | 1232243 | A | 10/1999 |

(Continued)

OTHER PUBLICATIONS

Chinese Certificate of Patent dated Nov. 26, 2008, for corresponding Chinese application 200610006731.2, noting listed references in this IDS.

(Continued)

*Primary Examiner*—Richard Hjerpe
*Assistant Examiner*—Mansour M Said
(74) *Attorney, Agent, or Firm*—Christie, Parker & Hale, LLP

(57) ABSTRACT

A field sequential LCD includes a reset selector supplying a reset signal having a higher voltage level than a data signal to the liquid crystal. The reset selector selects the reset signal in response to a reset control signal, and supplies the selected reset signal to a data line.

2 Claims, 4 Drawing Sheets

U.S. PATENT DOCUMENTS

| | | | | |
|---|---|---|---|---|
| 5,684,503 | A | 11/1997 | Nomura et al. | |
| 5,758,443 | A | 6/1998 | Pedrazzini | |
| 6,000,160 | A | 12/1999 | Riley | |
| 6,016,618 | A | 1/2000 | Attia et al. | |
| 6,061,045 | A | 5/2000 | Inaba | |
| 6,212,808 | B1 | 4/2001 | Rubel | |
| 6,496,174 | B2 | 12/2002 | Kurumisawa et al. | |
| 6,510,634 | B1 | 1/2003 | Riley | |
| 6,567,063 | B1 | 5/2003 | Okita | |
| 6,641,048 | B1 | 11/2003 | Schintz et al. | |
| 6,710,759 | B1 | 3/2004 | Kondoh | |
| 6,731,266 | B1 | 5/2004 | Jung | |
| 6,748,687 | B2 | 6/2004 | Riley | |
| 6,976,327 | B2 | 12/2005 | Goodin et al. | |
| 6,992,650 | B2 * | 1/2006 | Takei | 345/89 |
| 6,992,651 | B1 * | 1/2006 | Koyama et al. | 345/92 |
| 7,000,951 | B2 | 2/2006 | Valenti, Jr. | |
| 7,017,294 | B2 | 3/2006 | Riley | |
| 7,047,682 | B2 | 5/2006 | Riley | |
| 7,137,216 | B2 | 11/2006 | Ali et al. | |
| 7,221,344 | B2 | 5/2007 | Shimomaki | |
| 7,479,952 | B2 * | 1/2009 | Lee et al. | 345/204 |
| 2002/0041267 | A1 | 4/2002 | Jung | |
| 2002/0105492 | A1 | 8/2002 | Kosaka | |
| 2002/0135553 | A1 | 9/2002 | Nagai et al. | |
| 2002/0196224 | A1 | 12/2002 | Ham | |
| 2003/0030616 | A1 | 2/2003 | Maeda et al. | |
| 2003/0142050 | A1 | 7/2003 | Kim | |
| 2003/0222839 | A1 | 12/2003 | Lee | |
| 2004/0066363 | A1 | 4/2004 | Yamano et al. | |
| 2004/0113421 | A1 | 6/2004 | Penuela et al. | |
| 2004/0164544 | A1 | 8/2004 | Thall et al. | |
| 2005/0108912 | A1 | 5/2005 | Bekker | |
| 2005/0279001 | A1 | 12/2005 | Riley | |
| 2006/0055425 | A1 * | 3/2006 | Lu | 326/83 |
| 2006/0059753 | A1 | 3/2006 | Riley et al. | |
| 2006/0143961 | A1 | 7/2006 | Riley | |
| 2006/0174527 | A1 | 8/2006 | Henley | |
| 2006/0218837 | A1 | 10/2006 | Riley | |
| 2006/0230661 | A1 | 10/2006 | Bekker | |
| 2006/0242875 | A1 | 11/2006 | Wilson et al. | |
| 2007/0028495 | A1 | 2/2007 | Kotik et al. | |
| 2008/0098635 | A1 | 5/2008 | Jain et al. | |
| 2008/0110069 | A1 | 5/2008 | McDermott et al. | |

FOREIGN PATENT DOCUMENTS

| | | | |
|---|---|---|---|
| CN | 1363918 | | 8/2002 |
| CN | 1363918 | A | 8/2002 |
| EP | 0 949 605 | A1 | 10/1999 |
| JP | 4-186217 | | 7/1992 |
| JP | 10-206822 | | 8/1998 |
| JP | 2002-149127 | | 5/2002 |
| JP | 2002-333869 | | 11/2002 |
| JP | 2003-099015 | | 4/2003 |
| JP | 2003-107426 | | 4/2003 |
| JP | 2003-108083 | | 4/2003 |
| JP | 2003-131630 | | 5/2003 |
| JP | 2003-222835 | | 8/2003 |
| JP | 2003-345314 | | 12/2003 |
| JP | 2005-025179 | | 1/2005 |
| KR | 2001-0033515 | | 4/2001 |
| KR | 2002-0010653 | | 2/2002 |
| KR | 2003-0028386 | | 4/2003 |

OTHER PUBLICATIONS

Japanese Office action dated Dec. 2, 2008, for corresponding Japan application 2005-257448, noting references listed in this IDS.

Patent Abstracts of Japan, Publication No. 2003-108083, dated Apr. 11, 2003, in the name of Shingo Yamauchi.

China Office action dated Aug. 10, 2007, for CN200610006731.2 with English translation.

International Search Report and Written Opinion for related PCT Application No. PCT/US2008/065743, mailed on Oct. 2, 2008.

China Office action dated Aug. 10, 2007, for CN200610004230.0 with English translation.

Japanese Office action dated Dec. 9, 2008, for corresponding Japanese application 2005-224038, noting listed references in this IDS.

U.S. Office action dated Dec. 16, 2008, for related U.S. Appl. No. 11/329,823, noting listed U.S. references.

U.S. Office action dated Dec. 30, 2008, for related U.S. Appl. No. 11/329,828, noting listed U.S. references.

U.S. Office action dated May 26, 2009, for related U.S. Appl. No. 11/329,828, noting listed U.S. references 6;731,266, and U.S. Publication 2002/0196224 in this IDS.

U.S. Office action dated May 27, 2009, for related U.S. Appl. No. 11/329,823, noting listed U.S. reference 6;731,266 in this IDS.

Japanese Office action dated Oct. 7, 2008, for Japanese application 2005-237192, noting Japanese references previously filed in an IDS dated Oct. 9, 2006 and Feb. 25, 2009.

Patent Abstracts of Japan for Publication No. 04-186217; Dated Jul. 3, 1992 in the name of Katsumi Kurematsu.

* cited by examiner

FIELD SEQUENTIAL LIQUID CRYSTAL DISPLAY

CROSS-REFERENCE TO RELATED APPLICATION

This application claims priority to and the benefit of Korean Patent Application No. 2005-13785, filed Feb. 18, 2005, which is incorporated herein by reference in its entirety.

FIELD OF THE INVENTION

The present invention relates to a liquid crystal display (LCD), and more particularly, to a field sequential LCD.

BACKGROUND OF THE INVENTION

In a field sequential LCD, a pixel is sequentially illuminated with red light, green light, and blue light during one frame. In a typical thin film transistor (TFT) LCD, one pixel having three sub-pixels of red (R), green (G), and blue (B) displays an image containing the three colors simultaneously in one frame. In the field sequential LCD, unlike the TFT LCD, one pixel displays images of R, G and B in sequence during one frame.

Accordingly, the field sequential LCD does not necessarily include a color filter and displays an image having relatively high resolution compared with the TFT LCD. To perform a field sequential operation, one frame is divided into three sub-frames. That is, each frame is composed of a red field, a green field, and a blue field.

Each field has a reset period and a data programming period. During the reset period, a liquid crystal is initialized. During the data programming period, a data signal is applied to the initialized liquid crystal and the liquid crystal aligned in response to the data signal is illuminated with light. During the reset period, a reset signal is applied to the liquid crystal. The reset signal has a square pulse or square wave form.

FIG. 1 is a timing diagram illustrating a method of resetting a conventional field sequential LCD. Referring to FIG. 1, a frame is divided into three fields, e.g., into a red field, a green field and a blue field. Each field includes a reset period and a data programming period. For example, the red field includes a reset period and a data programming period. During the reset period, the voltage level of the reset signal applied to a corresponding pixel is equal to the voltage level of the data signal to be applied during the data programming period. Therefore, the pixel receives a square wave reset signal having a level of $\Delta V$ during the reset period.

However, the field sequential LCD does not have sufficient margin for the reset period, as compared with the TFT-LCD. Because one frame of the field sequential LCD has three fields and each field has a reset period and a data programming period, the reset period of the field sequential LCD is shorter than that of the TFT-LCD which resets only once per frame.

Further, the reset signal has the same voltage level as the data signal, therefore, the liquid crystal is not completely initialized. For example, when the liquid crystal has a relatively high transmittance by the data signal applied during a previous field, the transmittance of the liquid crystal should be lowered relatively more to initialize the liquid crystal during a current field. Here, the initialization of the liquid crystal depends on both the voltage level of the reset signal and the applied duration of the reset signal. Therefore, when the liquid crystal has a relatively high transmittance in the previous field, the liquid crystal is not completely initialized.

SUMMARY OF THE INVENTION

The present invention, therefore, provides a field sequential LCD that applies a reset signal having a higher level than a data signal.

In an exemplary embodiment of the present invention, a field sequential LCD includes: an LCD panel having a plurality of pixels to display an image; a gate driver supplying a scan signal to the LCD panel through a scan line; a source driver supplying a data signal to the LCD panel through a data line; and a reset selector supplying a reset signal having a higher voltage level than the data signal to the LCD panel during a reset period.

In another exemplary embodiment of the present invention, a field sequential LCD includes: an LCD panel having a pixel formed in a region in which a scan line intersects a data line to display an image; a gate driver supplying a scan signal to the pixel through the scan line; a source driver supplying a data signal having a first voltage level to the pixel through the data line; and a reset selector having a transmission gate connected to the data line, and supplying a reset signal having a second voltage level that is higher than the first level through the data line to the pixel during a reset period.

In one embodiment, the present invention is a method for driving a field sequential LCD having an LCD panel. The method includes: supplying a scan signal to the LCD panel through a scan line; supplying a reset signal having a first voltage level to the LCD panel through a data line; and supplying a data signal having a second voltage level lower than the first voltage level to the LCD panel initialized by the reset signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Hereinafter, exemplary embodiments of the present invention will be described with reference to the accompanying drawings.

Figure 1:
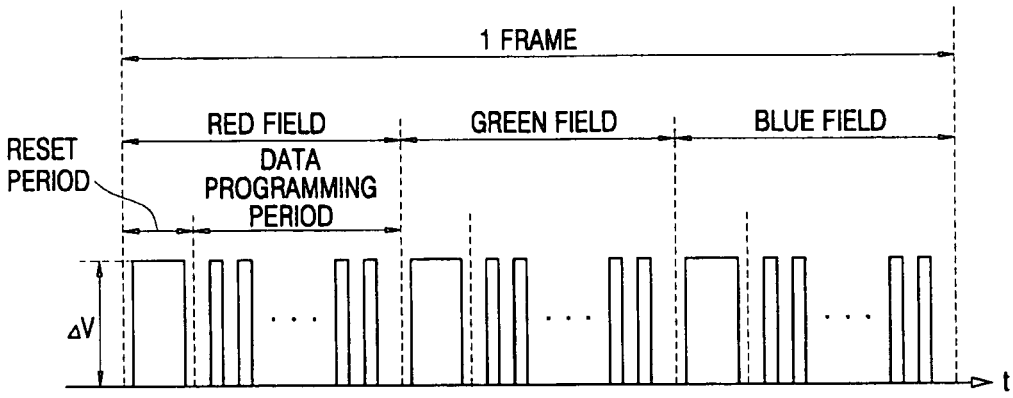
FIG. 1 (PRIOR ART)
FIG. 1 is a timing diagram illustrating a method of resetting a conventional field sequential LCD.
Figure 2:
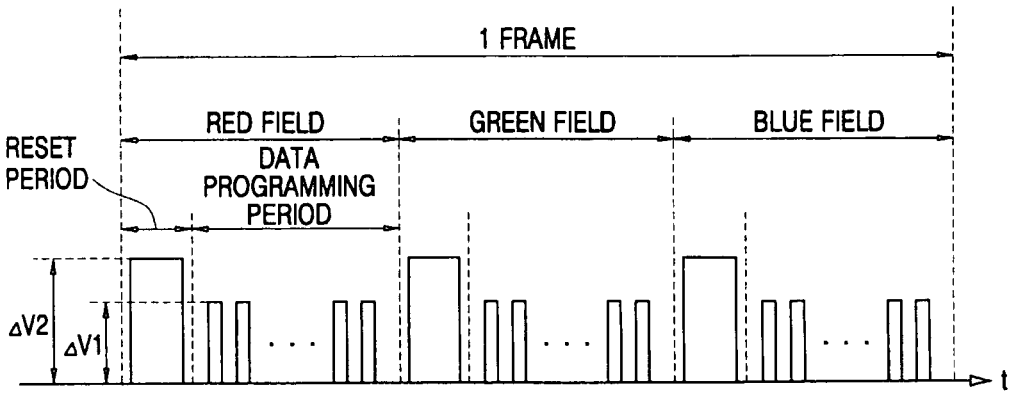
FIG. 2 is a timing diagram illustrating a method of driving a field sequential LCD according to an exemplary embodiment of the present invention.

FIG. 2 is a timing diagram illustrating a method of driving a field sequential LCD according to an exemplary embodiment of the present invention. Referring to FIG. 2, a frame, defined as a unit of displaying an image, synchronized with a vertical synchronous signal is composed of three fields, e.g., a red field, a green field and a blue field. Further, each field includes a reset period and a data programming period.

The reset period is a period required for initialization of the liquid crystal, and the data programming period is a period in which the initialized liquid crystal is aligned in response to an applied data signal and the aligned liquid crystal is illuminated with a backlight.

For example, the red field has the reset period and the data programming period. In the red field, a reset signal is applied to the liquid crystal. The reset signal has the form of a square wave. Further, the reset signal has a voltage level of ΔV2 that is higher than the data signal having a voltage level of ΔV1. In FIG. 2, the reset signal has one square pulse during the reset period, but the reset signal is not limited to just one pulse. Alternatively, the reset signal may have two or more square pulses. Also, in FIG. 2, a duration for which the reset signal has a voltage level of ΔV2 is shorter than the reset period, but it does not necessarily have to be shorter than the reset period. Alternatively, the duration for which the reset signal has a voltage level of ΔV2 may be equal to the reset period.

When the reset period of the red field ends, the data programming period of the red field begins. During the data programming period, the data signal for representing a predetermined gradation is applied to the liquid crystal initialized by the reset signal, and a red lamp is turned on while the data signal is continuously applied to the liquid crystal.

Here, the data signal has a voltage level of ΔV1 which is lower than the voltage level ΔV2 of the reset signal. Further, the data signal has the form of a square wave. The square wave may transmit information based on a pulse width varying according to pulse width modulation. When a plurality of square waves are applied to the initialized liquid crystal as the data signal, the initialized liquid crystal is aligned to have a predetermined transmittance corresponding to the data signal. When the liquid crystal is aligned, the red lamp is turned on. The red lamp emits red light to the liquid crystal having a predetermined transmittance, thereby representing a predetermined gradation.

When the data programming period of the red field ends, the reset period of the green field begins. During the reset period of the green field, the liquid crystal having a predetermined transmittance defined by the data signal applied during the data programming period of the red field is initialized. Here, the reset signal applied during the reset period of the green field has a voltage level of ΔV2. Further, the reset signal may have the form of a square wave and include two or more square waves.

As described above, when the reset period and the data programming period of the green field are performed in sequence and then the green field ends, the blue field begins. During the blue field, the liquid crystal having a predetermined transmittance corresponding to the data signal applied during the data programming period of the green field is initialized, and then the data signal is applied to the initialized liquid crystal. In the blue field, a blue lamp is turned on after the liquid crystal is aligned to have a predetermined transmittance corresponding to the data signal. Thus, red, green and blue gradations are represented in sequence during one frame, thereby displaying a predetermined image.

Figure 3:
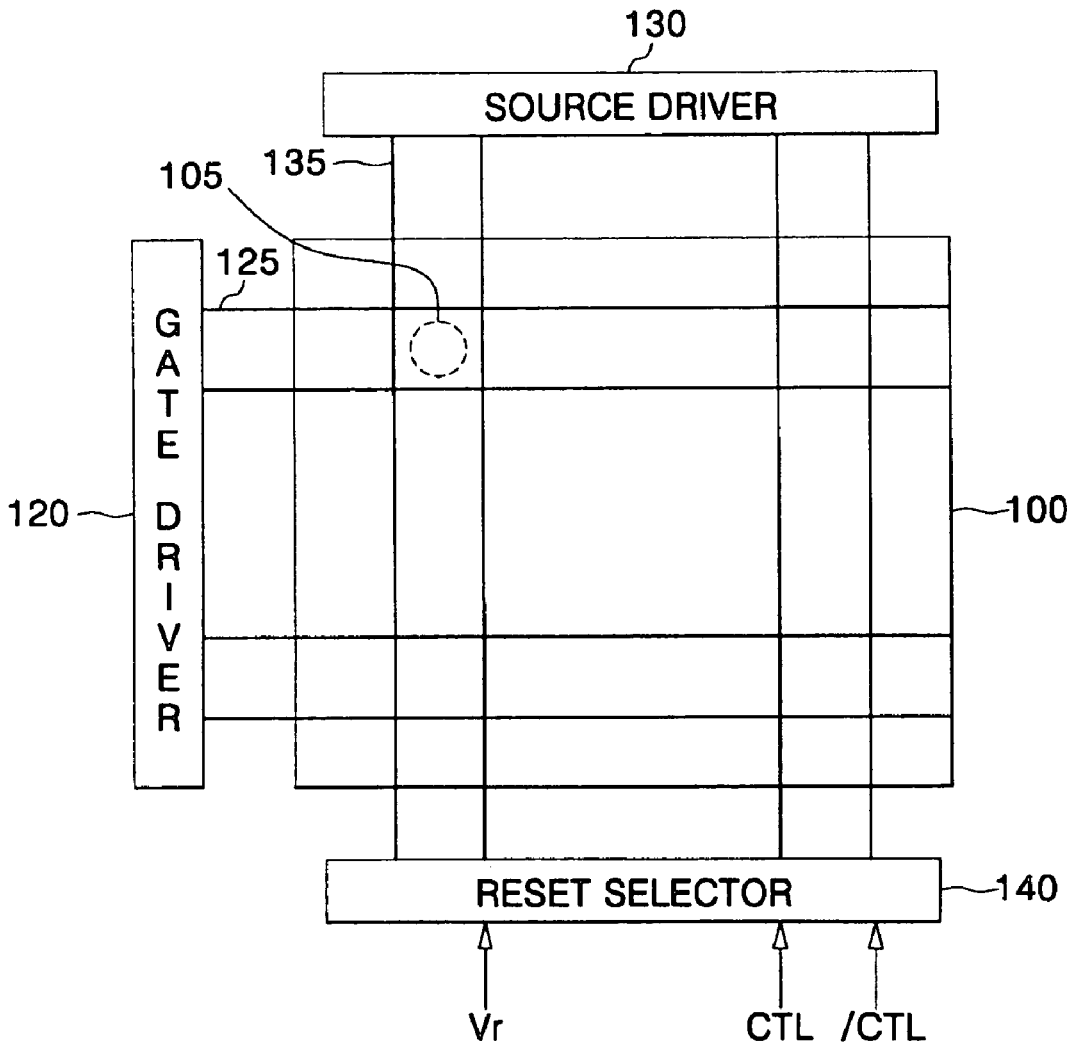
FIG. 3 is a block diagram of the field sequential LCD according to an exemplary embodiment of the present invention.

FIG. 3 is a block diagram of the field sequential LCD according to an exemplary embodiment of the present invention. Referring to FIG. 3, the field sequential LCD includes an LCD panel 100, a gate driver 120, a source driver 130, and a reset selector 140. The LCD panel 100 includes a plurality of pixels 105 formed in regions where a plurality of data lines 135 intersect a plurality of scan lines 125. When a scan signal is transmitted to the pixel 105 through the scan line 125, a thin film transistor of the pixel 105 is turned on, and thus a data signal is applied from the data line 135 to the liquid crystal via the thin film transistor turned on.

The gate driver 120 supplies a scan signal to the pixel 105 through the scan line 125. When the pixel 105 is selected by the scan signal, the pixel 105 can receive the data signal. The source driver 130 supplies a data signal to the pixel 105 through the data line 135. The data signal is supplied to the liquid crystal of the pixel selected by the scan signal, and the liquid crystal of the selected pixel is aligned to have a transmittance corresponding to the data signal.

The reset selector 140 supplies a reset signal having a voltage level of ΔV2, which is higher than the voltage level of the data signal (ΔV1), to the data line 135. That is, the reset selector 140 selects a reset signal Vr and supplies it to the data line 135 during the reset period of the pixel 105 of the LCD panel 100. Here, the reset signal Vr is selected by a reset control signal CTL or /CTL. As mentioned above, the reset signal Vr has a voltage level of ΔV2.

During the reset period, the data signal supplied from the source driver 130 is interrupted, and the reset selector 140 selects the reset signal Vr in response to the reset control signal CTL or /CTL, thereby supplying the reset signal Vr having a voltage level of ΔV2 to the data line 135.

During the data programming period, the reset selector 140 interrupts the reset signal Vr in response to the reset control signal CTL or /CTL. That is, the reset selector 140 does not select the reset signal Vr. On the other hand, the source driver 130 supplies the data signal having a voltage level of ΔV1 through the data line to the pixel selected by the scan signal.

Figure 4:
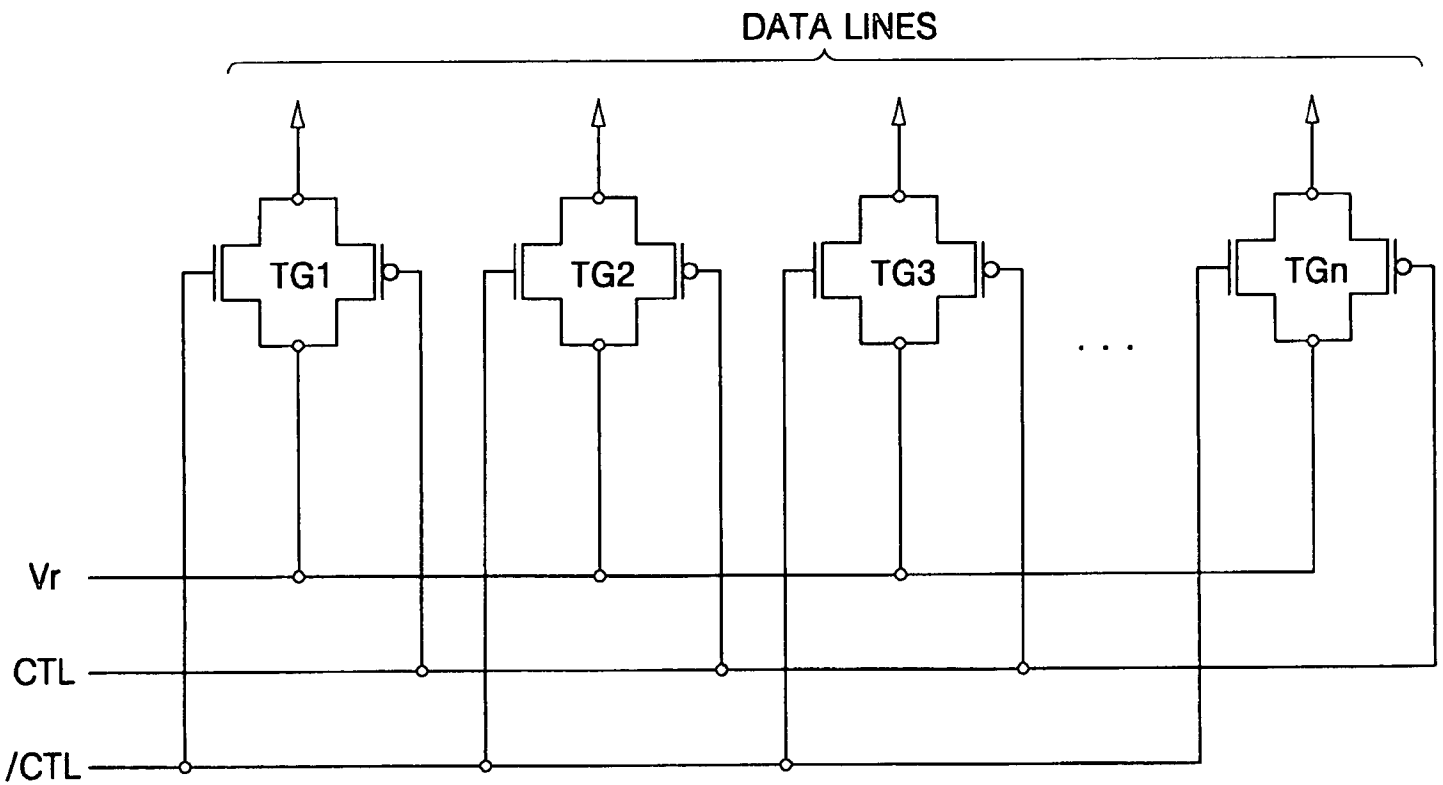
FIG. 4 is a circuit diagram of a reset selector provided in the field sequential LCD according to an exemplary embodiment of the present invention.

FIG. 4 is a circuit diagram of a reset selector provided in the field sequential LCD according to an exemplary embodiment of the present invention. Referring to FIG. 4, the reset selector includes a plurality of transmission gates. Each transmission gate has a structure in which an n-channel metal oxide semiconductor (NMOS) transistor and a p-channel metal oxide semiconductor (PMOS) transistor are connected in parallel. Alternatively, the transmission gate may consist of one PMOS transistor.

In the case where the transmission gate consists of one PMOS transistor, the reset control signal CTL is applied to a gate terminal of each PMOS transistor. The PMOS transistor has a first electrode to receive the reset signal Vr, and a second electrode connected to the data line. The number of PMOS transistors corresponds to the number of data lines. That is, each data line is connected to the second electrodes of a respective PMOS transistor. Hence, when the number of data lines is n, the number of PMOS transistors provided in the reset selector is also n. The PMOS transistor is tuned on/off in response to the reset control signal CTL applied to the gate terminal thereof. As the PMOS transistor is turned on, the reset signal Vr applied to the first electrode is supplied to the data line.

In the case where the transmission gate includes a NMOS transistor and a PMOS transistor connected to each other in parallel, the NMOS transistor and the PMOS transistor are turned on/off at the same time. Further, the inverted reset control signal /CTL is applied to the gate terminal of the NMOS transistor provided in each transmission gate, and the reset control signal CTL is applied to the gate terminal of the PMOS transistor of each transmission gate.

Also, the reset signal Vr is applied to the first electrode of each transmission gate. As described above, the reset signal Vr has a voltage level of of ΔV2. Preferably, the reset signal Vr is a direct current (DC) voltage having a level of ΔV2. Further, the second electrode of each transmission gate is connected to each data line. Preferably, the number of transmission gates is equal to the number of data lines.

When the reset control signal CTL has a low level and the inverted reset control signal /CTL has a high level, the PMOS and NMOS transistors of the transmission gate are turned on. Then, the reset signal Vr is applied to the respective data line through the turned-on transistors.

Therefore, n transmission gates TG1, TG2, . . . , TGn corresponding to the number of data lines are turned on at the same time and supply the reset signal Vr to the data lines. The reset signal supplied to the pixel through the data line initializes the liquid crystal.

On the other hand, when the reset control signal CTL has a high level and the inverted reset control signal /CTL has a low level, the PMOS and NMOS transistors of the transmission gate are turned off. As the transmission gate is turned off, the reset signal Vr is not applied to the data line.

Figure 5:
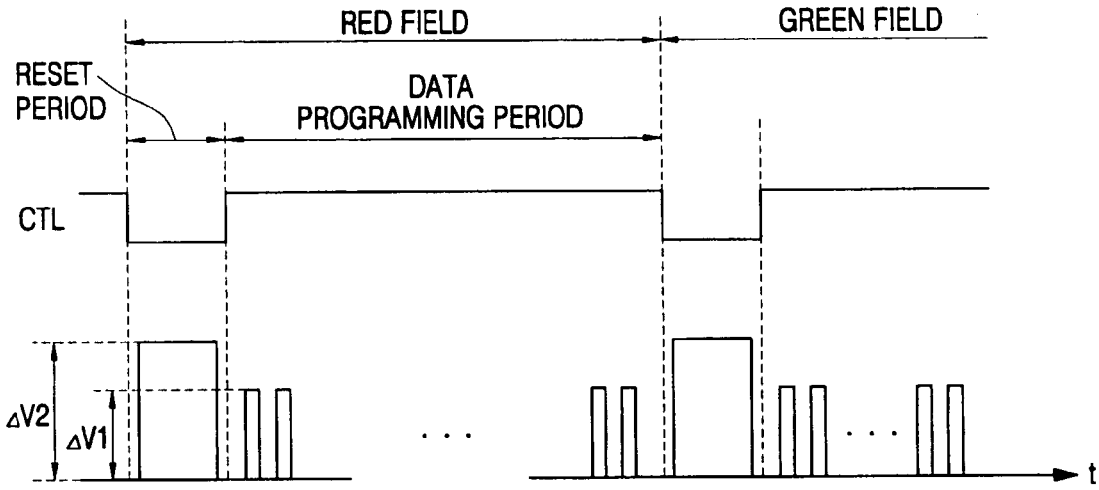
FIG. 5 is a timing diagram illustrating signals for driving the reset selector according to an exemplary embodiment of the present invention.

FIG. 5 is a timing diagram illustrating signals for driving the reset selector according to an exemplary embodiment of the present invention. Referring to FIG. 5, the red field has the reset period and the data programming period. During the reset period, the reset control signal CTL is maintained in the low level, and the inverted reset control signal /CTL is maintained in the high level. As a result, the transmission gates TG1, TG2, . . . , TGn of the reset selector are turned on, and thus the reset signal Vr having a voltage level of ΔV2 is transmitted to the data line. Then, the reset signal Vr is applied from the data line to the liquid crystal, thereby initializing the liquid crystal.

When the reset period ends, the data programming period begins. During the data programming period, the reset control signal CTL is maintained in the high level, and the inverted reset control signal /CTL is maintained in the low level. Subsequently, the transmission gates TG1, TG2, . . . , TGn of the reset selector are turned off, and the reset selector interrupts the reset signal. Further, during the data programming period, the data signal is applied to the pixel selected by the scan signal. Here, the data signal has a voltage level of ΔV1 which is lower than the voltage level ΔV2 of the reset signal.

When the data programming period of the red field ends, the green field begins. During the green field, the liquid crystal is initialized, the data signal is applied to the liquid crystal, and a green lamp is turned on. Following the green field, the foregoing processes are also performed for the blue field.

Through the foregoing processes, the reset signal having a higher level than the data signal is applied to the liquid crystal corresponding to the pixel, thereby initializing the liquid crystal sufficiently.

According to an exemplary embodiment of the present invention, the reset selector is configured to selectively supply the reset signal having a higher voltage level than the data signal to the pixel, so that the liquid crystal is sufficiently initialized. Further, the reset period required to initialize the liquid crystal can be reduced, so that a timing margin required to initialize the liquid crystal per sub-frame is also secured.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A field sequential liquid crystal display (LCD) comprising:

an LCD panel having a pixel formed in a region in which a scan line intersects a data line to display an image;

a gate driver supplying a scan signal to the pixel through the scan line;

a source driver supplying a data signal having a first voltage level to the pixel through the data line; and a reset selector having a transmission gate connected to the data line, and supplying a reset signal having a second voltage level that is higher than the first voltage level through the data line to the pixel during a reset period, wherein the transmission gate of the reset selector includes a PMOS transistor, wherein the number of transmission gates corresponds to the number of data lines, and wherein the PMOS transistor of the transmission gate includes:

a gate terminal to which a reset control signal is applied for turning the PMOS transistor on or off;

a first electrode to which the reset signal is applied; and a second electrode connected to the data line, and supplying the reset signal from the first electrode to the pixel through the data line in response to the reset control signal.

2. A field sequential liquid crystal display (LCD) comprising:

an LCD panel having a pixel formed in a region in which a scan line intersects a data line to display an image;

a gate driver supplying a scan signal to the pixel through the scan line;

a source driver supplying a data signal having a first voltage level to the pixel through the data line; and a reset selector having a transmission gate connected to the data line, and supplying a reset signal having a second voltage level that is higher than the first voltage level through the data line to the pixel during a reset period, wherein the transmission gate of the reset selector includes a PMOS transistor and an NMOS transistor connected to each other in parallel and the number of transmission gates corresponds to the number of data lines, and wherein the transmission gate includes:

a gate terminal of the PMOS transistor that receives the reset control signal for turning the PMOS transistor on or off;

a gate terminal of the NMOS transistor that receives an inverted reset control signal for turning the NMOS transistor on or off;

a first electrode to which the reset signal is applied; and a second electrode connected to the data line, and supplying the reset signal from the first electrode to the pixel through the data line in response to the reset control signal.

* * * * *